United States Patent [19]

Shingu et al.

[11] 4,409,887

[45] Oct. 18, 1983

[54] HYDRAULIC APPARATUS

[75] Inventors: Shitta Shingu, Tokyo; Atsushi Takahashi; Isao Kosugi, both of Yokohama, all of Japan

[73] Assignee: Tokyo Shibaura Denki Kabushiki Kaisha, Kawasaki, Japan

[21] Appl. No.: 283,550

[22] Filed: Jul. 15, 1981

Related U.S. Application Data

[62] Division of Ser. No. 45,869, Jun. 6, 1979, Pat. No. 4,318,332.

[30] Foreign Application Priority Data

Jun. 13, 1978 [JP] Japan ..... 53-70357

[51] Int. Cl.[3] ..... F15B 11/04; F15B 13/042

[52] U.S. Cl. ..... 91/446; 91/449; 91/DIG. 2

[58] Field of Search ..... 91/446, 468, DIG. 2, 91/444, 443, 449; 60/466

[56] References Cited

U.S. PATENT DOCUMENTS

| | | | |
|---|---|---|---|
| 1,524,497 | 1/1925 | Astrom et al. . | |
| 1,964,196 | 6/1934 | Cuttat . | |
| 3,018,902 | 1/1962 | Minty . | |
| 3,125,319 | 3/1964 | Arbogast et al. | 91/468 |
| 3,141,386 | 7/1964 | Loughridge . | |
| 3,171,331 | 3/1965 | Samuel | 91/443 |
| 3,437,012 | 4/1969 | Bjorklund | 91/446 |
| 3,633,461 | 1/1972 | Komatsu-shi et al. | 91/446 |
| 3,779,017 | 12/1973 | Fujisawa et al. . | |
| 4,197,785 | 4/1980 | Weber | 91/446 |
| 4,218,957 | 8/1980 | Underwood | 91/446 |

FOREIGN PATENT DOCUMENTS

| | | | |
|---|---|---|---|
| 716365 | 8/1965 | Canada | 60/466 |
| 2206765 | 8/1973 | Fed. Rep. of Germany . | |
| 2358057 | 8/1974 | Fed. Rep. of Germany . | |
| 48-26349 | 6/1973 | Japan . | |

*Primary Examiner*—Martin P. Schwadron
*Assistant Examiner*—Richard L. Klein
*Attorney, Agent, or Firm*—Oblon, Fisher, Spivak, McClelland & Maier

[57] ABSTRACT

In a hydraulic apparatus, an operating oil delivered from a fixed delivery hydraulic pump is divided into two parts, one of which is discharged into an oil tank by passing through a serial circuit consisting of a normally open valve and an orifice and the other of which is supplied to a piston-cylinder means by passing through a parallel circuit consisting of a normally closed valve and a check valve. When the normally closed valve is closed and the normally open valve is gradually closed, the piston is raised while gradually increasing in velocity. On the other hand, when the normally open valve is totally opened to stop the piston and the normally closed valve is gradually opened, the piston is lowered while gradually increasing in velocity. When the valves are operated to cause the piston to move vertically, the impact applied thereto at the time when the valve opening is large is largely mitigated by using said orifice.

1 Claim, 9 Drawing Figures

HYDRAULIC APPARATUS

This is a division, of application Ser. No. 045,869, filed June 6, 1979, now U.S. Pat. No. 4,318,332.

BACKGROUND OF THE INVENTION

1. Field of the Invention

This invention relates to a hydraulic apparatus including a piston for putting a load thereon; a hydraulic cylinder for causing the piston to move vertically; a hydraulic fixed delivery pump for supplying an operating oil to the hydraulic cylinder; a normally closed valve connected between the hydraulic pump and the hydraulic cylinder; a check valve connected in parallel to the normally closed valve to permit the flow of the operating oil only toward the hydraulic cylinder; an oil tank; a normally open valve connected to a pipe passage for transmitting to the oil tank the operating oil delivered from the hydraulic pump; a control circuit for piston-raising operation for controlling the normally open valve so as to smaller the oil passage thereof in the case of raising the piston and so as to totally open the normally open valve in the case of lowering the piston; and a control circuit for piston-lowering operation, for controlling the normally closed valve so as to totally close the same in the case of raising the piston and so as to enlarge the oil passage thereof in the case of lowering the piston.

2. Description of the Prior Art

Conventionally, various hydraulic apparatuses of the above-mentioned type were in practical use. A typical one of such apparatuses is a hydraulic elevator apparatus which is constructed as follows. A load is put on the upper end of a piston which is driven vertically through the interior of the hydraulic cylinder. When the piston is raised, an operating oil is supplied from a hydraulic fixed delivery pump to the hydraulic cylinder through an appropriate hydraulic circuit or circuits. When the load is lowered, the operating oil in the cylinder is discharged. The flow of the operating oil delivered from the pump, namely, the flow of the pressure oil, is parted into two, one of which is supplied to an oil tank through a normally open valve and the other of which is supplied to the lower end portion of the cylinder through a parallel circuit which includes a check valve and a normally closed valve. The check valve is disposed with its flow direction so set as to check the flow of the operating oil from the hydraulic cylinder toward the pump.

Even when the pump is being operated, only if the normally closed valve is totally closed and the normally open valve is totally opened, the operating oil delivered from the pump is allowed to flow into the oil tank and is prevented from being supplied to the cylinder. Thus, the piston is neither raised nor lowered.

When it is desired to raise the piston, the opening of the normally open valve is reduced in size. Then, the operating oil flowing through the normally open valve is reduced in volume. The operating oil of the amount which corresponds to this reduction is supplied under pressure into the cylinder by passing through the check valve. Thus, the piston is raised. The more the opening of the normally open valve is reduced in size, the more the piston velocity is increased. If this valve is totally closed, the piston velocity will reach its highest value.

When it is desired to lower the piston, the pump is kept inoperative and, the normally open valve is totally opened and the normally closed valve is appropriately opened. The pressure oil inside the hydraulic cylinder is discharged therefrom owing to the weight of the piston and load and is allowed to pass through each of the normally open and normally closed valves to flow into the oil tank. Thus, the piston is lowered. The more the opening of the normally closed valve is enlarged, the more the piston velocity is increased.

When vertically moving the piston by controlling the normally open valve and normally closed valves, the piston usually is driven as follows. First, the piston is caused to start its movement from its resting position or its first level position toward a desired level position. Then, the piston velocity is increased at a specified acceleration to reach a specified first piston velocity. The position which corresponds to the commencement of this velocity is now referred to as a second level position. Thereafter, the piston is moved at said first velocity to reach a position at which the piston starts to be so decelerated as to smoothly and precisely stop at the desired level position. This position is referred to as a third level position. Such deceleration is effected at a specified deceleration, whereby the piston velocity is decelerated towards a second specified velocity. The position of the piston which corresponds to the commencement of this second velocity is now referred to as a fourth level position. Thereafter, the piston is moved at the second specified velocity to reach a specified level position. This position is referred to as a fifth level position. The piston which has passed over this fifth position is kept moving during the time it is being decelerated substantially at a fixed rate and is stopped at a sixth level position which is the desired level position. The above-mentioned piston velocity, piston acceleration, piston deceleration and piston-velocity change-over position are so chosen as to permit the piston to stop smoothly at its specified position as promptly as it is permitted.

In the process of the piston movement, the piston velocity, piston acceleration or piston deceleration is changed over at the above-mentioned first to sixth level positions. Accordingly a force is applied, to the piston, i.e., an impact force which moves the piston with a large acceleration and large acceleration change with time. This movement is herein called "impact movement". This force is determined by change in the quantity of operating oil flowing into, or out of, the hydraulic cylinder due to opening or closing of the normally open valve or normally closed valve. The larger this change, the greater this impact force. This creates a danger in operating the apparatus or causes damage to the apparatus itself, and when the apparatus is used for an elevator, makes it uncomfortable to ride on.

From the foregoing description as to the opening or closing operation of the normally open valve and normally closed valve at the time of raising or lowering the piston, the following will be understood. At the time of raising the piston, the change-over of the piston velocity at the above-mentioned level positions 1, 4, 5 and 6 is effected when the normally open valve is totally opened or almost so opened. Further, the change-over of the piston velocity at the above-mentioned, level positions 2 and 3 is effected when the normally open valve is totally closed or almost so closed. At the time of lowering the piston, the change-over of the piston velocity at the level positions 1, 4, 5 and 6 is effected when the normally closed valve is totally closed or nearly so closed. Further, the change-over of the piston velocity at the level positions 2 and 3 is effected when the normally closed valve is totally opened or almost so opened.

The usual valve which is used as the normally open valve and the normally closed valve for the conventional apparatus has the characteristics that, in the region of small opening, the rate of change of the valve opening based upon the change in the valve stroke is low, and accordingly the rate of change of the oil quantity passing through the valve based upon the change in the valve stroke is low. In the region of the large valve opening however, the respective rates of changes of the valve opening and oil quantity are high. At the time of raising the piston, therefore, the impact movement caused to the piston at the second and third level positions is small and the impact movement caused thereto at the first, fourth, fifth and sixth level positions is large. At the time of lowering the piston, the former impact movement is large and the latter one is small. In this way, the impact movement which occurs in the piston may vary with the direction in which the piston is moved and the degree of opening given when the piston receives the impact force. Since in this way the impact force acting on the piston varies with the conditions when it is produced, the mechanical strength of the piston-cylinder section and the mechanisms associated therewith must be respectively made strong enough to resist the maximum impact force. This is not preferable in designing the apparatus.

It is also not preferable since in the case of using the apparatus for an elevator the apparatus becomes uncomfortable to ride on since the user is given a feeling of discomfort or uncertainty.

SUMMARY OF THE INVENTION

The object of the invention is to provide a hydraulic apparatus which has removed the above-mentioned drawbacks inherent in the above-mentioned conventional apparatus and undergoes only the impact movement less caused to the piston at the times of raising and lowering the piston.

For the purpose of achieving the above object, an orifice is provided for the hydraulic apparatus of the invention in a manner that it is connected in series with a normally open valve.

When the piston is raised or lowered up to a specified position by controlling the strokes of the normally open valve and normally closed valve, the impact movement conveyed to the piston in the region of large valve opening can be suppressed by the use of the orifice. The reason for this is as follows.

As explained previously, the usual normally open valve and normally closed valve, in the region of large valve opening, indicate respectively high rates of changes of their opening, accordingly of their flowing quantity, based upon the change of their stroke. Therefore, when the valve stroke is varied, the piston is frequently caused to make impact movement. However, if as in the invention an orifice is inserted into a pipe passage connecting the normally open valve and an oil tank, the orifice exhibits a resistance to operating-oil flow which increases with an increase in the quantity of the operating oil passing therethrough. At the time of the piston-raising operation, this flow resistance is applied substantially serially to the normally open valve and, at the time of piston-lowering operation, is applied substantially serially to the normally closed valve. Accordingly, the quantity of the operating oil which passes through either valve, as it increases, correspondingly decreases more than in the case where the orifice is not used. Accordingly, the greater the quantity of the operating oil, the lower the rate of change of the valve opening based upon the change of the valve stroke. For this reason, the impact movement caused to the piston is mitigated by the use of such orifice.

According to a preferred embodiment of the invention, the orifice is formed such that its opening is variable. This opening is controlled in accordance with the pressure of the normally closed valve at the hydraulic-cylinder side. In the apparatus having this construction, the effect of the orifice to suppress the occurrence of the impact movement of the piston can be prevented from being varied due to the weight of a load put on the piston, namely the valve upstream pressure.

According to another preferred embodiment of the invention, a parallel circuit including an orifice and a check valve is inserted into a pipe passage connecting the normally closed valve and hydraulic cylinder. This check valve is arranged to check the flow of the operating oil from the hydraulic cylinder toward the normally closed valve. By the use of the parallel circuit, the difference in the impact buffer effect between the piston-raising operation and the piston-lowering operation can be reduced which is attributed to a usual difference between the pressure resulting from the delivery of operating oil from the pump in the piston-raising operation and the pressure of the operating oil discharged from the cylinder in the piston-lowering operation.

According to still another preferred embodiment of the invention, in addition to the insertion of the parallel circuit into the pipe passage according to the preferred embodiment of the invention, a check valve is connected in parallel with the orifice inserted into a pipe passage connecting the normally open valve and oil tank. This check valve is so controlled as to allow the operating oil to flow from the normally open valve toward the oil tank when at the time of piston-lowering operation the pump is kept inoperative with the consequence that its delivery pressure will become zero. In the apparatus having this construction, the impact movement and the mitigation action thereof at the time of piston-raising operation are allowed to occur separately from those at the time of piston-lowering operation. The mitigation effect in the former case can be easily controlled independently from that in the latter case. This offers a great convenience in operation.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
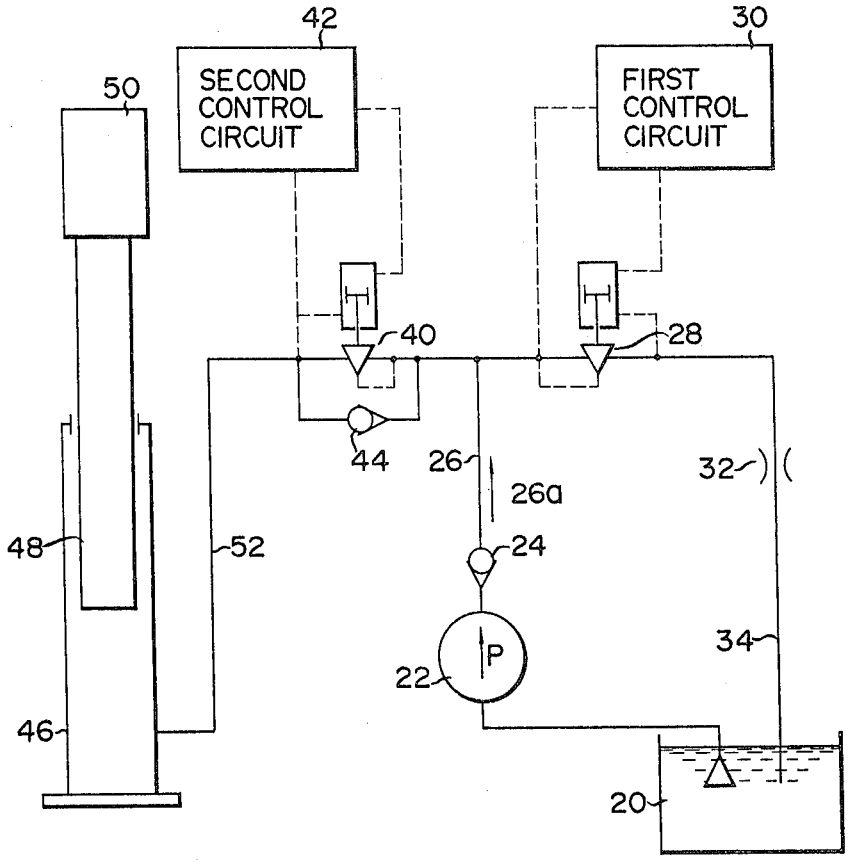
FIG. 1 shows a hydraulic apparatus according to a first embodiment of the invention.

FIG. 1 shows hydraulic apparatus according to a first embodiment of the invention. Referring to FIG. 1, numeral 20 designates an oil tank; 22 a hydraulic fixed delivery pump, and 24 a check valve. Further, numeral 26 designates a first pipe passage for delivering the operating oil pumped up by the hydraulic pump 22 from the oil tank 20, through the check valve 24 and in a direction shown by an arrow 26*a*. Numeral 28 designates a normally open valve, 30 a first control circuit or piston raising control circuit for controlling the normally open valve 28 and 32 an orifice. Further, numeral 34 designates a second pipe passage which is connected with the forward end of the first pipe passage taken as viewed in the direction shown by the arrow 26*a*, the second pipe passage being intended to discharge part or the whole of the operating oil delivered from the first pipe passage 26 in accordance with the opening of the normally open valve 28 into the oil tank 20 through the orifice 32. Numeral 40 designates a normally closed valve, 42 a second control circuit or piston lowering control circuit for controlling the normally closed valve 40, 44 a check valve connected in parallel with the normally closed valve 40, 46 a hydraulic cylinder for causing an upward and downward moving of a piston 48 and 50 a load put on the piston 48. Numeral 52 designates a third pipe passage which communicates with the forward end of the first pipe passage 26 and is connected with the lower end portion of the hydraulic cylinder 46 by passing through a parallel circuit including the normally closed valve 40 and check valve 44. This pipe passage 52 is intended to feed the operating oil into the hydraulic cylinder 46 when the piston 48 is desired to be raised.

The check valve 24 so acts as to prevent the operating oil from moving through the first pipe passage 26 in an opposite direction to that shown by the arrow 26*a*. The check valve 44 permits the operating oil delivered from the hydraulic pump 22 to move solely toward the hydraulic cylinder 46 and prevents it from moving in the opposite direction. The broken lines which connect the normally open valve 28 with the piston raising control circuit 30 and connect the normally closed valve 40 with the piston lowering control circuit 42, respectively, indicate control pipe passages. Broken lines shown in FIGS. 5, 6 and 7 similarly indicate control pipe passages in FIGS. 5, 6 and 7, respectively.

The operation of the device according to the first embodiment shown in FIG. 1 will now be described. When the raising and lowering control circuits 30 and 42 are out of operation, the normally open valve 28 is kept open and the normally closed valve 40 is kept closed. Accordingly, even when in this state the hydraulic pump 22 is in operation, the operating oil sucked up from the oil tank 20 totally returns to it through the second pipe passage 34 and there is no operating oil which passes through the third pipe passage 52 to flow into the hydraulic cylinder 46. Accordingly, in such state, the piston 48 is not raised. Further, the operating oil which receives, owing to the weight of the piston 48 and load 50, the pressure to cause it to flow back, is prevented by the normally closed valve 40 and check valve 44 from flowing back into the first and second pipe passages 26 and 34. Accordingly, the piston 48 is not lowered.

When operating the raising control circuit 30 to close the normally open valve 28, the pressure in the pipe passage between the check valve 24 and each of the valves 28, 40 is increased to permit the operating oil to pass through the check valve 44 and then through the third pipe passage 52 to enter the lower end portion of the hydraulic cylinder 46. Accordingly, the piston 48 and load 50 are raised by degrees. Upon more strongly closing the normally open valve 28, the flowing quantity of the operating oil passing through the check valve 44 is increased to cause the piston 48 to rise at a higher velocity. When totally closing the valve 28, the piston 48 rises at its maximum velocity.

When it is desired to lower the piston 48, the first and second control circuits 30 and 42 are so operated as to cause the normally open valve 28 to be wholly opened and the normally closed valve 40 to be suitably opened, and, further, the hydraulic pump 22 is stopped.

By such operation the operating oil in the hydraulic cylinder 46 is pushed downward by the weight of the piston 48 and load 50 and is discharged from the cylinder 46. Then this operating oil passes through the normally closed valve 40, normally open valve 28 and orifice 32 and passes through the second pipe passage 34 so as to flow into the oil tank 20. Thus, the piston 48 is lowered. If in the above-mentioned operation the normally closed valve 40 is opened to a large extent, piston 48 is lowered at a correspondingly high velocity. If the valve 40 is opened totally, the piston 48 is lowered at its maximum velocity.

Figure 2:
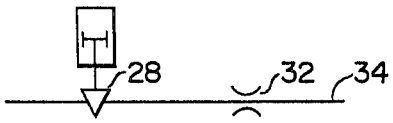
FIG. 2 is a view explaining the serial circuit including a normally open valve and orifice which is used for the embodiment shown in FIG. 1.

By controlling the normally open valve 28 and normally closed valve 40 in the above-mentioned manner, the piston 48 can be raised or lowered up to a desired position. According to the device shown in the first embodiment, the impact movement of the piston 48 which unavoidably occurs in a conventional device is largely reduced. According to the invention, the orifice 32 so acts as to suppress such occurrence of the impact movement of the piston. For explaining the action of the orifice 32, we now refer to the valve opening characteristics, in relation to the valve 28, of the second pipe passage 34. FIG. 2 is a view illustrating the above-mentioned second pipe passage.

Assuming now that t represents the opening of the valve 28; n a ratio of the sectional area of the orifice 32 to the opening area of the normally open valve at the time of its being totally opened; and $\eta$ the opening of an equivalent valve substituted for the orifice 32 and normally open valve 28, that is, the coupled equivalent opening of the equivalent value, opening $\eta$ is calculated by the following equation on the continuation principle of flow. Note here that $\eta$ also indicates what percentage the quantity of the operating oil flowing through the second pipe passage 34 is which is reached when the orifice 32 has been applied accounting for that which is reached when the orifice 32 is not applied.

$$\eta = \frac{nt}{\sqrt{t^2 + n^2}}$$

Figure 3:
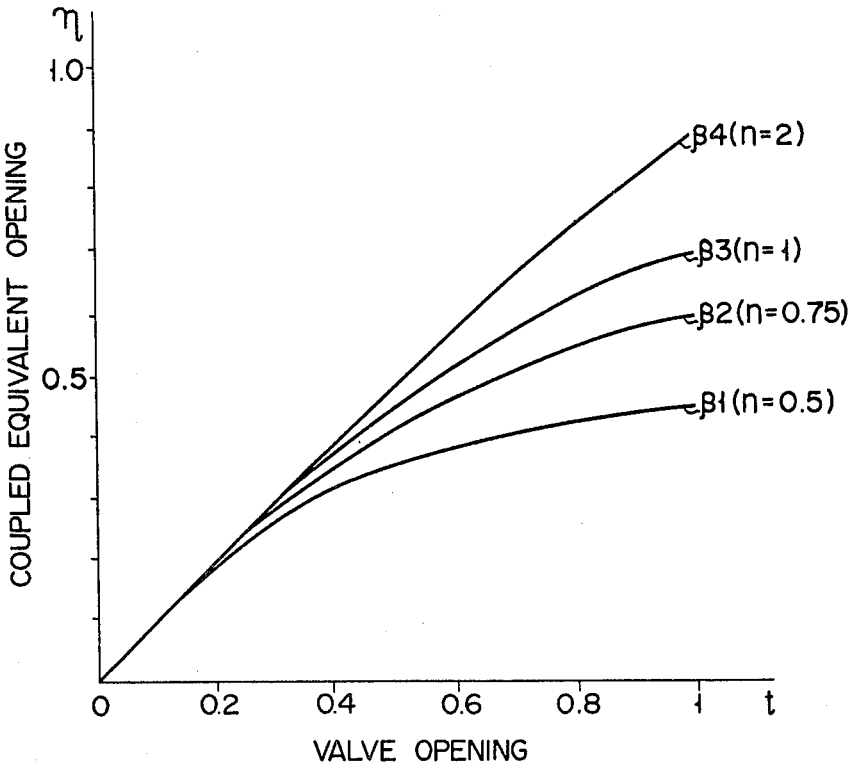
FIG. 3 graphically shows the relationship of the opening of the valve (x-axis) used in FIG. 2 with that of an equivalent valve (y-axis), the equivalent valve having the same valve opening characteristic as the serial circuit of FIG. 2

FIG. 3 graphically shows the relationship of t which holds true when t is plotted on the abscissa and $\eta$ on the ordinate. The curves $B_1$, $B_2$, $B_3$ and $B_4$ correspond to the valves of n 0.5, 0.75, 1 and 2, respectively.

Figure 4:
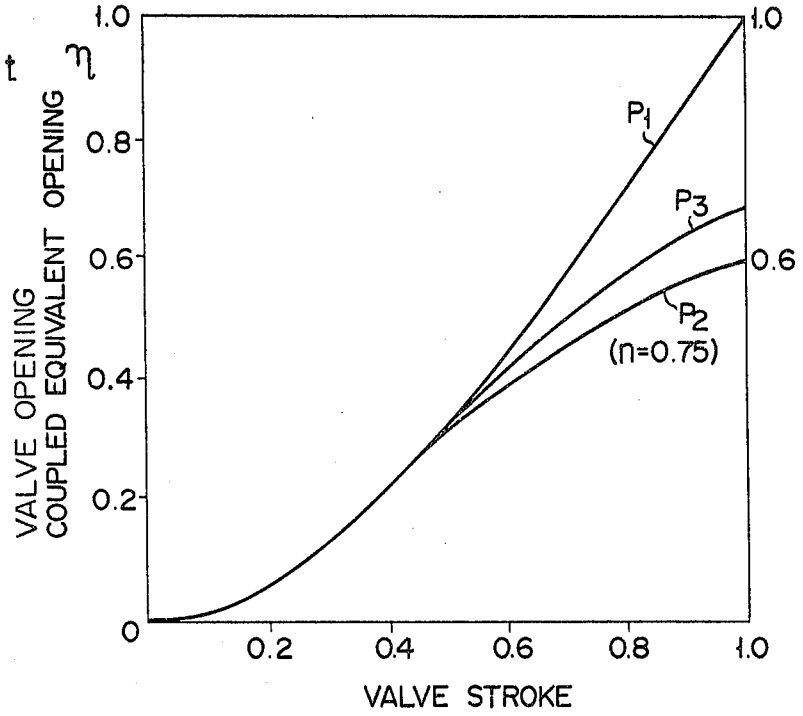
FIG. 4 graphically shows the relationship of the stroke of the valve used in FIG. 2 with the opening thereof and with the coupled equivalent opening of the equivalent valve of FIG. 3.

In FIG. 4, the stroke s of the valve 28 is used as the abscissa and the opening t of the valve 28 as the ordinate. Curve $P_1$ represents the relationship of s with t which holds true when the orifice 32 is not utilized, and the curve $P_2$ the relationship of s with the coupled equivalent opening $\eta$ which holds true when an orifice of n=0.75 has been connected in series to the valve 28.

As seen, in the region of smaller values, the curves $P_1$ and $P_2$ rise at the low rate of increase with respect to an increase in s and rise at the high rate of increase with respect to a larger increase in s. $P_1$ and $P_2$ thus indicate much the same pattern until a certain valve point in the Figure, approximately 0.4 of s, is reached. In the region of s larger than such point, the curve $P_1$ continues to rise while its rate of increase is kept constant, thus reaching a maximum opening relationship of 1.0. On the other hand, the curve $P_2$ which the relationship of s with the coupled equivalent opening $\eta$ separates from the curve $P_1$ to gently rise (increasing at a gradually reduced rate) as s increases. Thus, the curve $P_2$ reaches a maximum valve (in this embodiment, 0.6) of the coupled equivalent opening. In this way, the coupled equivalent opening $\eta$ of the equivalent valve only indicates a small change both at smaller and larger value regions of the valve stroke with respect to the change in the valve stroke.

The effect as indicated by the curve $P_2$ which has been obtained from the combination of the applied orifice 32 with the normally open valve 28, will also similarly be produced with respect to a combination of the orifice 32 with the normally closed valve 40 which is opened when the piston is lowered. In the conventional device using no such orifice 32, impact movement indeed occurred on the piston during the piston-raising operation in which the normally open valve is largely opened and during the piston-lowering operation in which the normally closed valve is largely opened. According to the invention, however, such impact movement of the piston is suppressed by addition of the orifice 32.

Since in this way the impact movement of the piston 48 is due to a large opening of the normally open valve 28 and normally closed valve 40, the device can be safely operated and the resulting small impact force applied thereto also permits extension of the life thereof and permits easy maintenance thereof. Further, when apparatus of the invention is used for an elevator, an impact force generated to the user becomes very small with a result that a comfortable elevator ride can be obtained. However, since as seen from FIG. 4 the maximum opening of the valve will be reduced by application of the orifice 32 to 60% as large as that which is permitted without the orifice 32, account should be taken of this in using a normally open valve 28 and an orifice 32 which have large capacities, respectively.

Figure 5A:
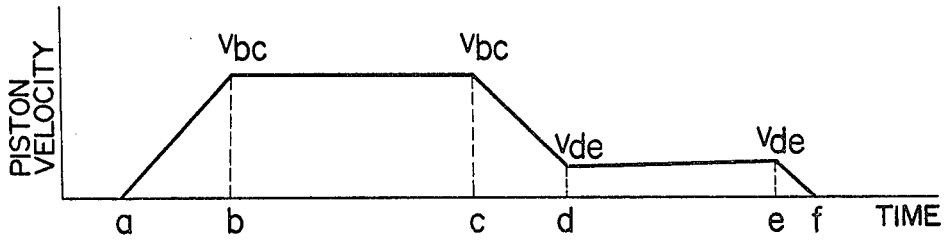
FIG. 5A graphically shows a pattern of the usual control of the piston velocity, in relation to time, which is performed when lifting the load by using the device according to the invention.
Figure 5B:
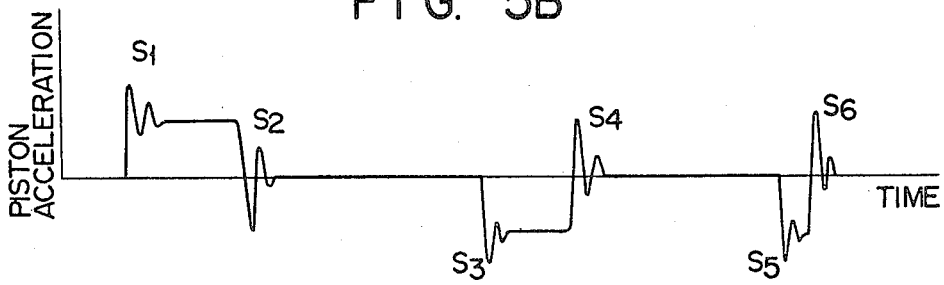
FIG. 5B graphically shows a typical pattern of the change of piston velocity in relation to time which occurs when lifting the load by using the device according to the invention.

FIG. 5A illustrates a pattern of usual control of the piston velocity which is performed when the piston 48 is raised from some level position or a first level position to a desired level position or a second level position. FIG. 5B illustrates a pattern of acceleration which is applied to the piston as a result of the velocity control of the piston. In both FIGS. 5A and 5B, the axis of abscissa represents time passage and the axis of ordinate indicates the change in acceleration. In FIG. 5A, the piston at the time of rising at a specified acceleration and at the time of b rising at a specified velocity $V_{bc}$. Thereafter, the piston rises at the same velocity $V_{bc}$ until the time c and at this point c rises at a first specified deceleration. Thereafter, the piston ceases to be decelerated at a point d where it has been decelerated to a relatively low velocity $V_{de}$. Thereafter, it rises at the velocity $V_{de}$ until the point e. Thereafter, it rises at a second specified deceleration and at a point f ceases to rise.

In the above-mentioned velocity pattern, the acceleration given to the piston at the time of a and the succeeding velocity of the piston are respectively so chosen as to permit the piston to have the velocity of $V_{bc}$ as promptly as it is permitted, thus reaching the level position where it starts to be decelerated, as promptly as it is permitted. The time c when the piston starts to be decelerated is so chosen as to permit the piston to reach the above-mentioned second position from its resting position at the time c, as promptly as it is permitted, by its movements respectively at the two separate stges of decelerations and at the specified piston-raising velocity set therebetween. The reason why the piston is arranged to undergo two such separate stages of deceleration is to at first reduce the piston-raising velocity and then precisely stop the piston at the second position or desired stop position without generating a great impact upon the piston.

The valve used to realize the velocity pattern illustrated in FIG. 5A is the above-mentioned normally open valve 28. As will be understood from the previous explanation, the operation of the normally open valve 28 at the times a, d, e and f is performed during the operating period of time in which the piston is raised at low velocity and the valve 28 is largely opened.

Accordingly, in the conventional device without the orifice 32, the piston is indeed only caused to create a slight impact movement at times b and c, but it receives a great impact at times a, d, e and f. In the acceleration pattern illustrated in FIG. 5B the damping oscillation waves indicated by $S_1$, $S_2$, $S_3$, $S_4$, $S_5$ and $S_6$ are the representations, in terms of acceleration, of the impact forces which are applied to the piston where the orifice 32 is not used. Where the orifice 32 is used as shown in the embodiment of FIG. 1, such vibration waveforms are suppressed to a remarkable extent.

Also in the case where the piston is lowered from its high-level resting position to a low level position, it is at first lowered from its resting position at a specified acceleration and then lowered at a first specified velocity. Then, the piston is lowered at a first specified deceleration and then lowered at a second specified velocity. Then, the piston is lowered at a second specified deceleration and is thus stopped at its desired resting position. In this case, the velocity pattern of the piston is the same as that which is obtained by reversing the sign of the velocity pattern under the mode of the piston-raising operation. Detailed explanation concerning the same, therefore, will be omitted. The valve in this piston-lowering operation which is operated for controlling the piston velocity is the normally closed valve 40. At the corresponding times to the points a, d, e, and f of FIG. 5A, the normally closed valve 40 is opened to a relatively small extent and at the corresponding times to the points b and c of FIG. 5A the valve 40 is opened to a large extent. At the corresponding times to the points b and c, therefore, the impact forces given the piston, though becoming great where the orifice 32 is net used, can be mitigated by the use of the orifice 32.

Connecting the orifice 32 in series to the normally open valve 28 as in the above-mentioned embodiment is indeed effective in reducing the impact movement which occurs in the piston 48. The following followings, however, should be improved further.

First, even when the opening of the normally open valve 28 is kept fixed, the moving velocity of the piston 28 fails to be so maintained due to a upstream value pressure produced owing to the weight of the load 50 put on the piston 28. For example, where the load 50 put on the piston is exchanged for a large load, the valve upstream pressure applied to the normally open valve 28 on the inlet side thereof is increased to cause an increase in the flowing quantity of the operating oil which is discharged into the oil tank 20 through the orifice 32. This means that the coupled valve opening is enlarged. This results in a decrease in the flowing quantity of the operating oil which is to be supplied to the hydraulic cylinder 46. In this manner, the velocity at which the piston 48 is raised decreases when the load increases.

If, in case the upstream valve pressure is applied to the normally open valve 28 in the above-mentioned manner, consideration is given in connection with FIG. 4, to the relationship between the valve stroke and coupled equivalent opening of an equivalent valve including the normally open valve 28 and orifice 32, it will be understood from the previous explanation that the curve which represents such relationship assumes such pattern as is indicated by $P_3$ described between the curves $P_1$ and $P_2$. This is not preferable since it leads to reduction in the buffer effect upon the piston which has been obtained by providing the orifice 32. The curves $B_1$ to $B_4$ illustrated in FIG. 3 are all calculated on the basis of the valve upstream pressure as fixed. The embodiment of FIG. 1 is also designed so as to meet the conditions that the valve upstream pressure is fixed.

Figure 6:
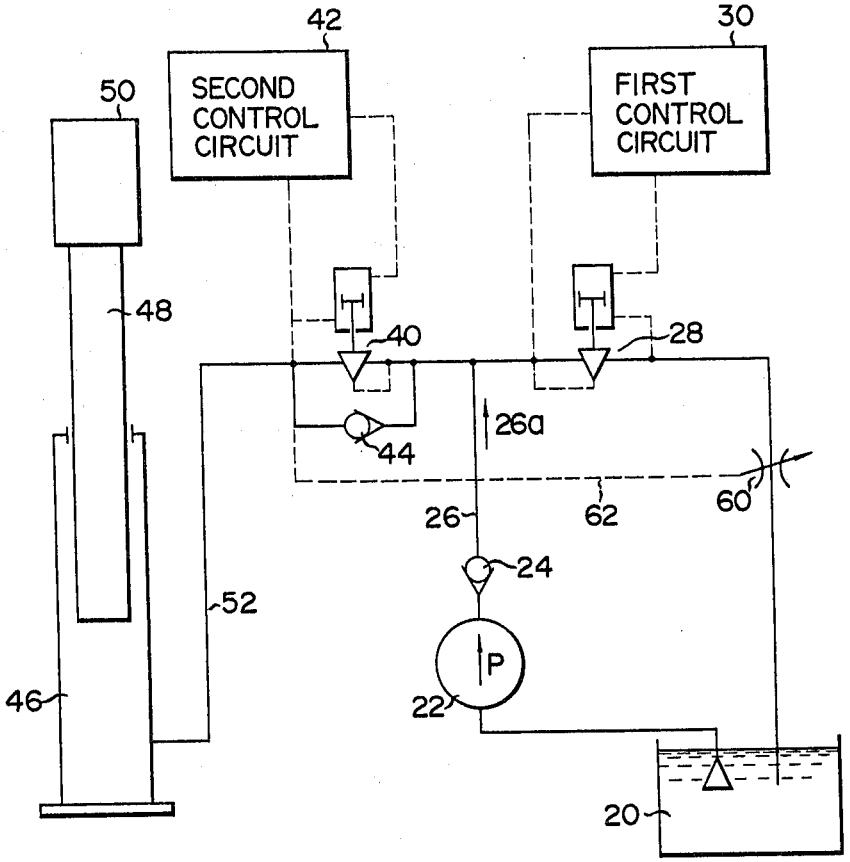
FIG. 6 shows a second embodiment of the invention.

An embodiment of the invention illustrated in FIG. 6 is utilized for the purpose of preventing the above-mentioned deterioration of the coupled equivalent opening curve. In this embodiment, the orifice 60 (corresponding to the orifice 32 of FIG. 1) fitted to the second pipe passage 34 is so designed that the opening area of the orifice can be varied and adjusted in accordance with the oil pressure of the normally closed valve 40 on the hydraulic-cylinder side. The control system for the embodiment of FIG. 6 is indicated by a broken line 62. When the load 50 is relatively heavy and the oil pressure inside the hydraulic cylinder 46, i.e., the valve upstream pressure is high, the opening of the orifice 60 is reduced with the result that the resistance to the flow of operating oil increases. This causes a reduction in the quantity of oil which is discharged through the normally open valve 28 and orifice 60. The greater this quantity of oil, the more this reduction. Thus, the above-mentioned deterioration of the coupled equivalent opening characteristics is prevented.

Secondly, the following points should be considered the device of the in connection with present invention for even further improvement. In FIG. 1, at the time of the piston-raising operation, the differential pressure which is applied to the normally open valve 28 is substantially equal to a valve obtained by subtracting the pressure drop by the orifice 32 from the pressure resulting from the force of oil of the hydraulic pump 22. At the time of the piston-lowering operation, the differential pressure which is applied to the normally closed valve 40 is substantially equal to a valve obtained by subtracting the pressure drop by the orifice 32 from the oil pressure inside the hydraulic cylinder 46. Since the oil delivery pressure of the hydraulic pump has a different valve from the hydraulic cylinder, even if the same type of valve is used both as the normally open valve 28 and as the normally closed valve 40, the differential pressure which is applied to each of the valve 28 and 40 at the time of the piston-raising operation differs from that at the time of the piston-lowering operation. Accordingly, the relationship between the valve stroke and the valve opening to the normally open valve 28 differs from that to the normally closed valve 40. This results in an undesirable difference in shock absorbing effect between at the time of the piston raising operation and at the time of the piston lowering operation.

Figure 7:
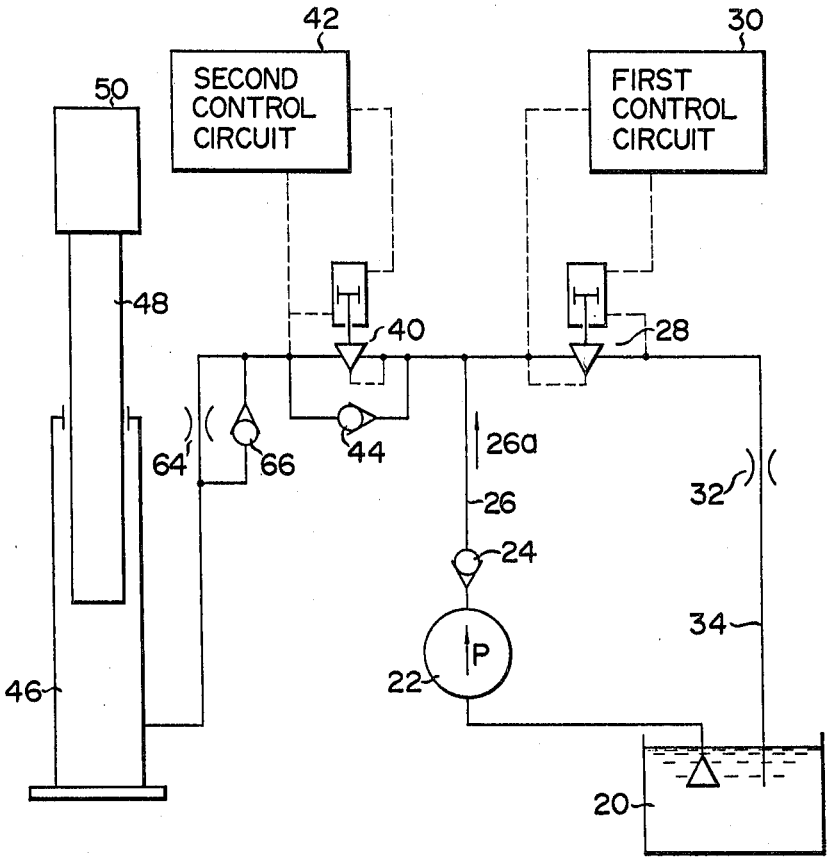
FIG. 7 shows a third embodiment of the invention.
Figure 8:
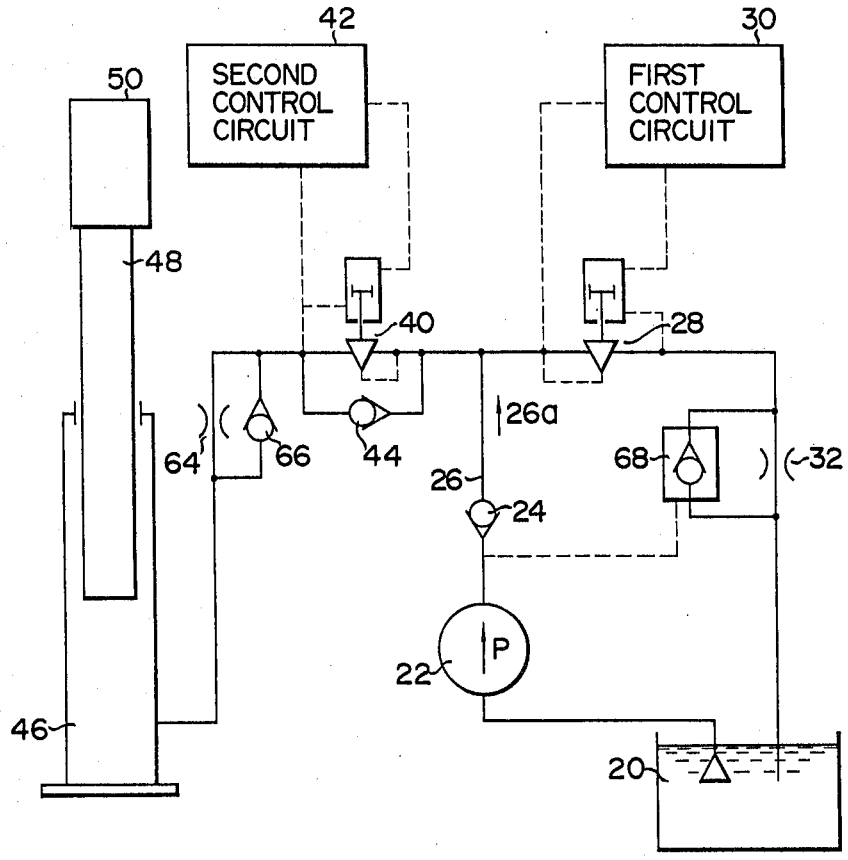
FIG. 8 shows a fourth embodiment of the invention.

The following embodiments of FIGS. 7 and 8 are for the purpose of reducing the difference in buffer effect. The embodiment illustrated in FIG. 7 is the same as that illustrated in FIG. 1 excepting that an orifice 64 is serially provided for the third pipe passage 52 connecting the normally closed valve 40 and the hydraulic cylinder 46 and that a check valve 66 is connected in parallel with the orifice 64. This check valve 66 is so provided as to check the flow of the operating oil from the hydraulic cylinder 46 toward the normally closed valve 40. In the device illustrated in FIG. 7, where the piston 48 is raised by gradually closing the normally open valve 28, the operating oil is allowed to flow in the hydraulic cylinder 46 through the check valve 66 and the orifice 64 has no effect upon such flow of the operating oil occurs, whereby the piston 48 is raised as in the embodiment of FIG. 1. At the time of the piston-lowering operation, the operating oil inside the hydraulic cylinder 46 flows toward the normally closed valve 40 by passing through the orifice 64 and flows into the oil tank 20 through the totally opened valve 28 and the orifice 32. In this case, the orifice 64 is additionally provided in the return flow system of the operating oil unlike the piston-lowering operation of FIG. 1, with the result that the differential pressure applied to the normally closed valve 40 is reduced more than in the embodiment at FIG. 1. Thus, also in the piston-lowering operation, the buffer effect can be obtained substantially as in the piston-raising operation.

In the embodiment illustrated in FIG. 8, to orifice 32 illustrated in FIG. 7 is connected in parallel a check valve 68 which is kept closed so long as the oil delivery pressure of the hydraulic pump 22 is not zero. Accordingly, at the time of the piston-raising operation, since the hydraulic pump 22 is driven, the orifice 32 is effectively operated. At the time of the piston-lowering operation, since the hydraulic pump 22 is stopped to make its oil delivery pressure zero and the check valve 68 is opened, the orifice which operates in cooperation with the normally closed valve 40 is solely the orifice 64. Accordingly, the valve characteristics of the normally open valve 28 and normally closed valve 40 are improved by separately providing the orifices 32 and 64. Thus, a maximum buffer effect can be obtained with respect to each of the piston-raising and-lowering operations by selectively determining the orifices 32 and 64.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A hydraulic apparatus comprising:

a piston for carrying a load thereon;

a hydraulic cylinder for causing said piston to move vertically;

a hydaulic pump for supplying operating oil to said hydraulic cylinder;

a normally closed valve disposed in a conduit connected between said hydraulic pump and said hydraulic cylinder;

a check valve connected in parallel to said normally closed valve to permit the flow of the operating oil only toward said hydraulic cylinder;

an oil tank;

a normally open valve connected to a pipe passage for transmitting to said oil tank the operating oil delivered from said hydraulic pump;

a control circuit for piston-raising operation for controlling said normally open valve so as to reduce the oil passage thereof in the case of raising the piston and so as to totally open said normally open valve in the case of lowering the piston;

a control circuit for piston-lowering operation, for controlling said normally closed valve so as to totally close said normally closed valve in the case of raising the piston and so as to enlarge the oil passage thereof in the case of lowering the piston;

an orifice member provided on the downstream side of said normally open valve in a manner that it is connected in series thereto; and wherein said orifice member is so formed as to permit its opening to vary in opening area and further comprising means in fluid communication with the conduit portion between the normally closed valve and the hydraulic cylinder for controlling the opening of the orifice member in response to pressure variations in the conduit portion.

* * * * *